US006758542B2

(12) United States Patent
Mizutani et al.

(10) Patent No.: US 6,758,542 B2
(45) Date of Patent: Jul. 6, 2004

(54) INK JET RECORDING PROCESS AND INK JET RECORDING APPARATUS

(75) Inventors: Hajime Mizutani, Nagano (JP); Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/294,447

(22) Filed: Nov. 14, 2002

(65) Prior Publication Data

US 2004/0017409 A1 Jan. 29, 2004

(30) Foreign Application Priority Data

Nov. 16, 2001 (JP) ..... P.2001-352177

(51) Int. Cl.[7] ..... B41J 29/38; B41J 2/01

(52) U.S. Cl. ..... 347/5; 347/101; 347/102; 395/101

(58) Field of Search ..... 347/101, 100, 347/102, 5, 90; 395/101

(56) References Cited

U.S. PATENT DOCUMENTS 5,210,581 A * 5/1993 Kuzuya ..... 156/277
6,290,318 B1 * 9/2001 Yasukawa ..... 347/16
6,663,238 B2 * 12/2003 Kikuchi et al. ..... 347/102

* cited by examiner

*Primary Examiner*—Stephen D. Meier
*Assistant Examiner*—Manish Shah
(74) *Attorney, Agent, or Firm*—Ladas & Parry

(57) ABSTRACT

The invention relates to an ink jet recording process including an ink jet recording step of discharging one or more kinds of inks based on entered image information to record an image of one or more colors on a recording medium, and an overcoat step of forming a protective layer for covering the image on the recording medium, wherein control tables corresponding to changes in characteristics of the color(s) which occur by covering the color(s) output onto the recording medium with the protective layer are prepared beforehand, and in the ink jet recording step, discharge control of the ink(s) is performed in accordance with the control tables to record the image, thereby making it possible to faithfully reproduce the entered image information. Also disclosed is an ink jet recording apparatus suitable for the ink jet recording process.

17 Claims, 4 Drawing Sheets

| COLOR | CHARACTERISTIC VALUE | BEFORE COVERING WITH PROTECTIVE LAYER | AFTER COVERING WITH PROTECTIVE LAYER |
|---|---|---|---|
| Bk | L* VALUE | 8.7 | 4.2 |
| | a* VALUE | -0.7 | -0.2 |
| | b* VALUE | -3.5 | -1.3 |
| C | L* VALUE | 41.8 | 40.8 |
| | a* VALUE | -20.3 | -18.4 |
| | b* VALUE | -66.3 | -68.1 |
| M | L* VALUE | 42.6 | 42.3 |
| | a* VALUE | 78.1 | 80.3 |
| | b* VALUE | -13.0 | -12.6 |
| Y | L* VALUE | 87.6 | 87.7 |
| | a* VALUE | -4.5 | -4.8 |
| | b* VALUE | 108.1 | 111.1 |
| R | L* VALUE | 43.5 | 42.9 |
| | a* VALUE | 69.4 | 71.1 |
| | b* VALUE | 51.5 | 56.8 |
| G | L* VALUE | 33.5 | 32.5 |
| | a* VALUE | -74.5 | -77.9 |
| | b* VALUE | 23.3 | 25.6 |
| B | L* VALUE | 13.3 | 10.3 |
| | a* VALUE | 33.7 | 38.4 |
| | b* VALUE | -57.8 | -60.5 |

NOTE: THE PROTECTIVE LAYER IS A COATING OF A RESIN EMULSION "EX-35" (MANUFACTURED BY NIPPON SHOKUBAI CO., LTD.). THE RECORDING MEDIUM IS "PREMIUM GLOSSY PHOTO PAPER (PM PHOTOGRAPHIC PAPER)" MANUFACTURED BY SEIKO EPSON CORPORATION.

FIG. 4

| COLOR | CHARACTERISTIC VALUE | BEFORE COVERING WITH PROTECTIVE LAYER | AFTER COVERING WITH PROTECTIVE LAYER |
|---|---|---|---|
| Bk | L* VALUE | 8.7 | 4.2 |
| | a* VALUE | -0.7 | -0.2 |
| | b* VALUE | -3.5 | -1.3 |
| C | L* VALUE | 41.8 | 40.8 |
| | a* VALUE | -20.3 | -18.4 |
| | b* VALUE | -66.3 | -68.1 |
| M | L* VALUE | 42.6 | 42.3 |
| | a* VALUE | 78.1 | 80.3 |
| | b* VALUE | -13.0 | -12.6 |
| Y | L* VALUE | 87.6 | 87.7 |
| | a* VALUE | -4.5 | -4.8 |
| | b* VALUE | 108.1 | 111.1 |
| R | L* VALUE | 43.5 | 42.9 |
| | a* VALUE | 69.4 | 71.1 |
| | b* VALUE | 51.5 | 56.8 |
| G | L* VALUE | 33.5 | 32.5 |
| | a* VALUE | -74.5 | -77.9 |
| | b* VALUE | 23.3 | 25.6 |
| B | L* VALUE | 13.3 | 10.3 |
| | a* VALUE | 33.7 | 38.4 |
| | b* VALUE | -57.8 | -60.5 |

NOTE: THE PROTECTIVE LAYER IS A COATING OF A RESIN EMULSION "EX-35" (MANUFACTURED BY NIPPON SHOKUBAI CO., LTD.). THE RECORDING MEDIUM IS "PREMIUM GLOSSY PHOTO PAPER (PM PHOTOGRAPHIC PAPER)" MANUFACTURED BY SEIKO EPSON CORPORATION.

INK JET RECORDING PROCESS AND INK JET RECORDING APPARATUS

FIELD OF THE INVENTION

The present invention relates to an ink jet recording process for recording an image by discharging ink onto a recording medium and to an ink jet recording apparatus. More particularly, the invention relates to an ink jet recording process containing an overcoat step of forming a protective layer on an image and an ink jet recording apparatus suitable for the recording process.

BACKGROUND OF THE INVENTION

The ink jet recording process is a recording process in which ink droplets are discharged through minute nozzles according to image information, and allowed to adhere to a recording medium, thereby making a print. By the recent innovative progress of the ink jet recording technology, the ink jet prints have reached a high level comparable in image quality to silver salt photographs, but have come short of the silver salt photographs yet in image fastness in the present state. In recent years, with the expansion of the ink jet recording technology to digital photograph service, commercial print applications and the like, importance has increasingly become to be attached to improvements in image fastness.

Further, as recording technology which can enhance image fastness and luster, there has been known overcoat treatment in which a recorded image is covered with a protective layer such as a transparent film. The overcoat treatment has also attracted attention in the ink jet recording field as a technique having the possibility that high image quality and high image fastness comparable to the silver salt photographs can be achieved, and various improved techniques have been proposed with respect to the materials and structures of the protective layers, forming processes or the like.

It is as described above that high image quality and high image fastness are required for the ink jet recording process. However, as a premise for that, it is needed that entered image information such as image information electronically taken in or accumulated in computers or networks, or image information taken in with digital cameras, digital videos or scanners is faithfully reproduced. For example, in a recording system provided with a host computer such as a personal computer and a recording device such as a printer connected thereto, a general ink jet recording system, the host computer conducts necessary processing such as binarization to the entered image information to form print data, which are supplied to a printer together with data indicating the kind of recording medium. The printer is constituted so as to perform the ejection control of ink corresponding to these data, thereby being able to reproduce approximately faithfully on the recording medium an image corresponding to the entered image information.

However, when the above-mentioned overcoat treatment technology is incorporated in the general ink jet recording system in order to achieve high image quality and high image fastness, the problem has been encountered that the image corresponding to the entered image information cannot be obtained. This is caused by changes in color characteristics generated by the overcoat treatment of the image normally output onto the recording medium (the image corresponding to the entered image information). Although a color reproduction region is enlarged with an increase in image density, changes come out in hue and contrast ratio of the image, resulting in failure to faithfully reproduce the entered image information. The shading ratio of the whole image changes to deflect from an intended expression, or the properties and degree of changes vary according to each color and shading. Accordingly, in the case of a color image, the balance of the whole image is lost. In some very extreme cases, such changes in hue that a blue printed area is tinged with green are also observed. It can be considered that it is a fetal defect of a recording system that the image corresponding to the entered image information cannot be obtained as described above.

SUMMARY OF THE INVENTION

The invention has been made in view of such problems, and an object of the invention is to provide an ink jet recording process which can faithfully reproduce entered image information, and can achieve high image quality and high image fastness comparable to a silver salt photograph. Another object of the invention is to provide an ink jet recording apparatus suitable for the recording process.

Other objects and effects of the invention will become apparent from the following description.

The above-mentioned objects of the invention have been achieved by providing the following ink jet recording process and ink jet recording apparatus.

An ink jet recording process comprising an ink jet recording step of discharging one or more kinds of inks based on entered image information to record an image of one or more colors on a recording medium, and an overcoat step of forming a protective layer for covering the image on the recording medium, wherein control tables corresponding to changes in characteristics of the color(s) which occur by covering the color(s) output onto the above-mentioned recording medium with the above-mentioned protective layer are prepared beforehand, and in the above-mentioned ink jet recording step, discharge control of the ink(s) is performed in accordance with the above-mentioned control tables to record the image, thereby making it possible to faithfully reproduce the entered image information; and An ink jet recording apparatus comprising an ink jet recording device for discharging one or more kinds of inks based on entered image information to record an image of one or more colors on a recording medium, and an overcoat device for forming a protective layer for covering the image on the recording medium, wherein the ink jet recording apparatus further comprises control tables corresponding to changes in characteristics of the color(s) which occur by covering the color(s) output onto the above-mentioned recording medium with the above-mentioned protective layer, and the above-mentioned ink jet recording device performs discharge control of the ink(s) in accordance with the above-mentioned control tables to record the image, thereby making it possible to faithfully reproduce the entered image information.

BRIEF DESCRIPTION OF THE DRAWINGS

FIG. 4 shows changes in characteristics between before and after the covering with the protective layer for colors output onto the recording medium.

Figure 1:
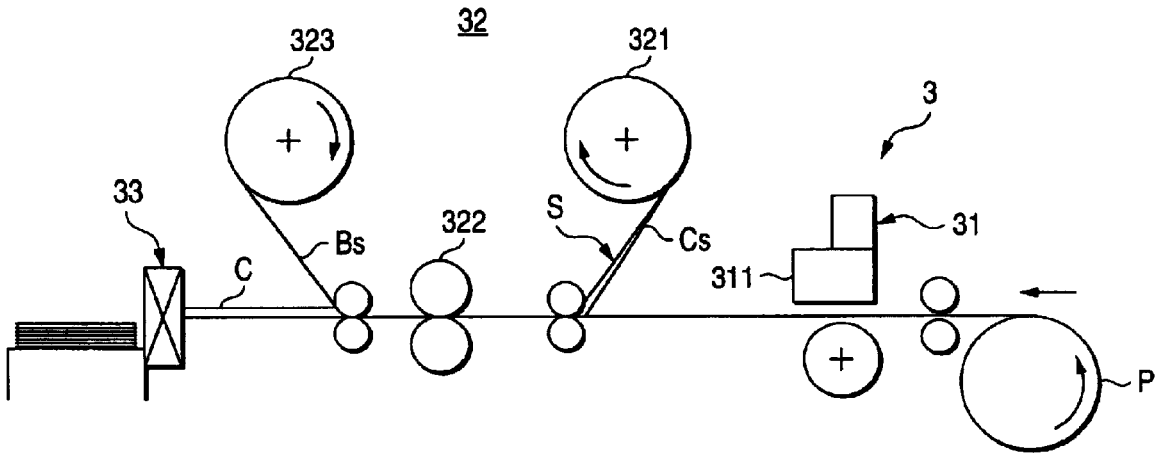
FIG. 1 is a view schematically showing a main part of an ink jet recording apparatus according to an embodiment of the invention.

Reference numerals in these drawings indicate the following members, respectively.

3: Ink jet recording apparatus

31: Ink jet recording device

32: Overcoat device

33: Cutter

311: Recording head

321: Sheet supply device

322: Hot pressing device

323: Separating device $B_s$: Support

C: Protective layer $C_s$: Layer to be transferred

P: Recording medium

S: Heat transfer sheet

DETAILED DESCRIPTION OF PREFERRED EMBODIMENTS

A preferred embodiment of the invention is illustrated below with reference to the drawings.

FIG. 1 is a view schematically showing a main part of an ink jet recording apparatus (printer) according to an embodiment of the invention. Printer 3 of FIG. 1 comprises ink jet recording device 31 for discharging one or more kinds of inks based on entered image information to record an image of one or more colors on a recording medium P taken up in a roll form, and overcoat device 32 for forming protective layer C for covering the image on the recording medium P, and is constructed in the same manner as with an ink jet printer of this kind with the exception that a mechanism necessary for overcoat treatment is provided.

The ink jet recording device 31 has a carriage for carrying recording head 311, a carriage belt for scanning the carriage in a definite direction and an ink cartridge for supplying ink to the recording head 311 (all are not shown in the drawing), as well as the recording head 311 discharging the ink through nozzles.

The recording head 311 has the plurality of nozzles, an ink supply passage, an energy acting unit attached to a part of the ink supply passage, and an energy generating device for generating droplet forming energy by allowing it to act on ink in the energy acting unit (all are not shown in the drawing). The energy generating devices include a system using an electromechanical transducer such as a piezoelectric element and a system in which ink is heated and discharged with an electrothermal transducer such as an exothermic element having an exothermic resistor, and either system can be used.

The overcoat device 32 is a device utilizes a heat transfer process, and has sheet supply device 321 for supplying, on support $B_s$, heat transfer sheet S having a layer $C_s$ to be transferred, hot pressing device 322 for heat pressing onto the image the layer $C_s$ to be transferred, and separating device 323 for separating the support $B_s$ after the heat pressing. The heat transfer process has the advantage that it is suitable for formation of a thin film of the protective layer, compared to other overcoat processes described later. The thin protective layer, particularly the thin protective layer having a thickness of 10 $\mu$m or less, is preferred, because there is little fear of impairing the original texture and feeling of a recorded matter.

The sheet supply device 321 has feed rolls, and can supply heat transfer sheet S taken up in a roll form, along a transfer direction of the recording medium P.

The hot pressing device 322 has a pair of heat rolls, and can conduct heat pressing treatment to a sheet-like material passing between the rolls.

The separating device 323 has a take-up roll, and only the support $B_s$ can be separated from the state where the recording medium P is integrated with the heat transfer sheet S, and taken up to recover it.

Further, cutter 33 is provided in the vicinity of a delivery of the printer, and the continuous sheet-like recording medium P having the protective layer C (recorded matter with the protective layer) can be cut to a desired length and delivered.

Figure 2:
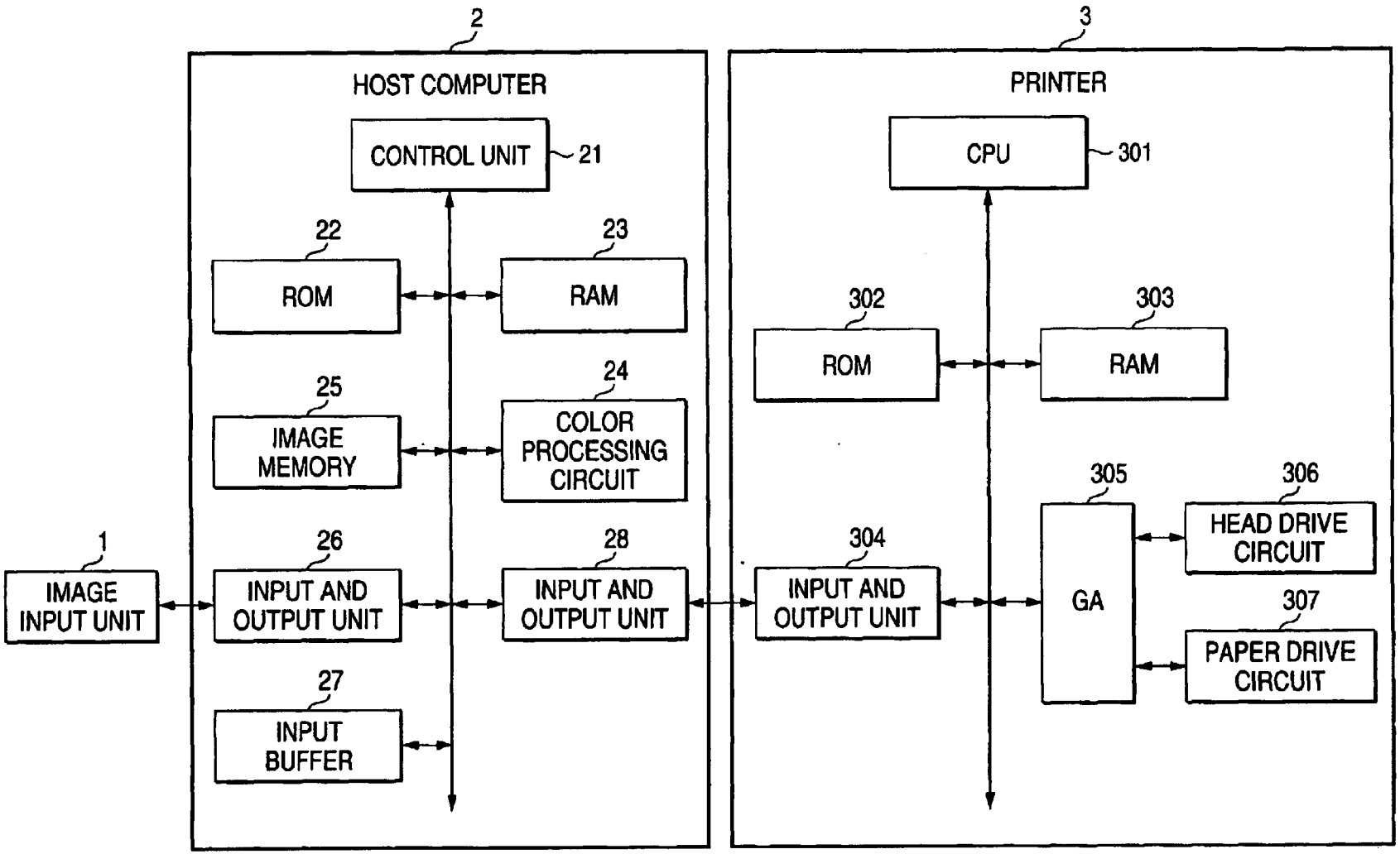
FIG. 2 is a block diagram showing control constitution of a recording system using the ink jet recording apparatus of FIG. 1.

FIG. 2 is a block diagram showing control constitution of a recording system using the ink jet recording apparatus of FIG. 1. This recording system has image input unit 1 and host computer 2, as well as the printer 3 having the constitution as described above.

Examples of the image input unit 1 include, for example, a scanner, a digital camera, a digital video or the like as a device which can transmit multi-valued color image information taken in to a personal computer or the like.

The host computer 2 has control unit 21 for substantially controlling the whole recording system, ROM 22 in which necessary constant information is stored, RAM 23 used as a working memory or the like, color processing circuit 24 for resolving image information (image data) received from the image input unit 1 into necessary color data, image memory 25 for storing data obtained by processing image information, input and output unit 26 for conducting the input and output with respect to the image input unit and an operation panel not shown in the drawing, input buffer 27 and input and output unit 28 for outputting data to the printer 3.

In the host computer 2, when the image information is received from the image input unit 1 through the input and output unit 26, this information is stored in the input buffer 27, subjected to necessary processing such as $\gamma$ correction by means of the color processing circuit 24, binarized, and stored in the image memory 25 as print data. Then, print data which is printed by one scan of the recording head 311 is read out therefrom, and sent to the printer 3 through the input and output unit 28.

Paper kind information indicating the kind of recording medium P or the kind of heat transfer sheet S (or the kind of layer $C_s$ to be transferred) and other various indicating information, as well as the image information from the image input unit 1, are input from a computer terminal unit not shown in the drawing to the input and output unit 26, and these information are also sent to the printer 3 together with the above-mentioned print data.

The printer 3 has CPU 301 for controlling the whole printer, ROM 302 in which necessary constant information such as control tables described later is stored, RAM 303 used as a working area of the CPU 301 or a temporary storage area of data, input and output unit 304 for conducting the input and output with respect to the host computer 2, gate array (GA) 305 for transmitting the print data to the recording head 311, head drive circuit 306 for discharging ink through the nozzles of the recording head 311, and paper drive circuit 307 for supplying a drive current to a paper feed and delivery mechanism for the recording medium P and the heat transfer sheet S.

Figure 3:
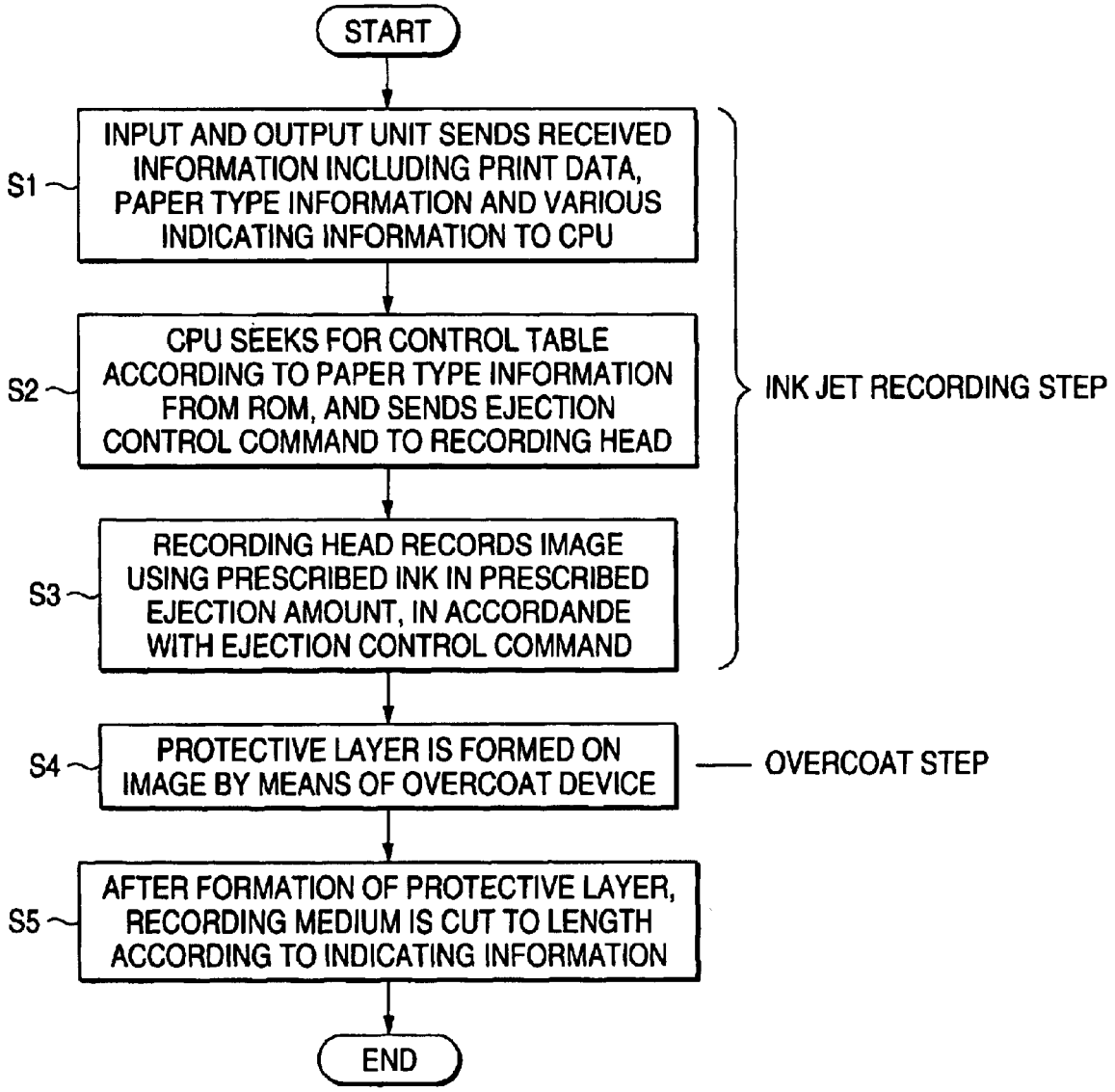
FIG. 3 is a flow chart showing a flow of processing conducted in the ink jet recording apparatus of FIG. 1.

FIG. 3 is a flow chart showing a flow of processing conducted in the printer 3. Referring to FIG. 3, when the input and output unit 304 receives the print data corresponding to the entered image information, the paper (recording medium and heat transfer sheet) kind information and the other various indicating information from the host computer 2, these are sent to the CPU 301 (step 1).

The CPU 301 seeks for a control table relating to suitable paper (recording medium and heat transfer sheet) from the plurality of control tables stored beforehand in the ROM 302, according to the paper kind information sent from the input and output unit 304, and sends a ejection control command of ink in accordance with the control table to the recording head 311 (head drive circuit 306) (step 2).

The recording head 311 makes an ink jet recording using prescribed ink in a prescribed ejection amount, in accordance with the ejection control command sent from the CPU 311, thereby recording an image on the recording medium (step 3).

After the image is recorded, the overcoat device 32 is driven through the paper drive circuit 307 to form the protective layer C on the image (step 4).

After the protective layer C is formed, the cutter 33 is driven to cut the continuous sheet-like recording medium (recorded matter with the protective layer) to a length according to the indicating information (step 5).

The overcoat step of step 4 will be described with reference to FIG. 1. The recording medium P (recorded matter) on which the image is recorded with the ink jet recording device 31 in the ink jet recording step (steps 1 to 3) is conveyed to the overcoat device 32. Then, the heat transfer sheet S is first supplied onto a recorded surface of the recorded matter with the sheet supply device 321. Here, the heat transfer sheet S is supplied in such a manner that the layer $C_s$ to be transferred is laid on top of the recording surface, with the layer $C_S$ placed on the underside. The recorded matter on which the heat transfer sheet S is placed is conveyed to the hot pressing device 322, and pressed with heating by passing it between the pair of opposed heat rolls. Then, at the time when the temperature is lowered, the support $B_s$ is separated with the separating device 323 to obtain the recorded matter with the protective layer C.

The above-mentioned control tables will be described. The control tables perform discharge control of the ink in the ink jet recording step prior to the overcoat step so as to record an image in which making allowance for changes in various characteristics such as hue, which occur by forming the protective layer on the image (conducting the overcoat treatment) in the overcoat step, these changes are deducted with respect to the entered image information (print data received by the printer 3). The data of changes in characteristics between before and after the covering with the protective layer, which are summarized for each one or more colors constituting the image, are stored in the control tables as data basic to such discharge control, which makes it possible to comply with changes in color characteristics.

FIG. 4 shows changes in characteristics between before and after the covering with the protective layer for colors in the low brightness region which are output onto the recording medium. The brightness index L* and the chromaticness indexes a* and b* defined in the CIE L*a*b* color space are noted herein as the color characteristics. As for the colors in the low brightness region (printed area), there is observed the tendency of the optical density (OD value) to increase by the covering with the protective layer, followed by changes in the L* value, the a* value and the b* value (changes in hue) as shown in FIG. 4 to enlarge a color reproduction region. Then, the control tables of this embodiment perform the discharge control of the ink so as to record an image in which changes in the L* value, the a* value and the b* value of each color caused by the overcoat treatment are deducted.

For example, when a final output image after the covering with the protective layer outputs a color represented by an L* value of 10.3, an a* value of 38.4 and a b* value of −60.5 (B of FIG. 4), the covering of this color with a protective layer (a coating of a resin emulsion "EX-35" (manufactured by NIPPON SHOKUBAI CO., LTD.) having a thickness of 10 $\mu$m) induces changes in the L* value, the a* value and the b* value. Accordingly, the kind of ink used and/or the discharge amount is actually controlled so as to output a color in which these changes are each deducted, that is, a color represented by an L* value of 13.3, an a* value of 33.7 and a b* value of −57.8, onto the recording medium.

That is, "the image in which the changes (in characteristics caused by the overcoat treatment) are deducted with respect to the entered image information" output in the ink jet recording step of this embodiment is an image in which the L* value, the a* value and the b* value are low (or high) by just those corresponding to the changes caused by the overcoat treatment, compared to an image (image obtained by an ordinary printer) which is output based on print data (prepared by the host computer 2) corresponding to the entered image information. This results in the expansion of the color region which can be substantially expressed.

The degree of the changes in color characteristics between before and after the covering with the protective layer varies according to the material and thickness of the protective layer, even in the case of the same color. Accordingly, in the case of a recording system in which plural kinds of protective layers are suitably used, it is preferred that a plurality of control tables are provided corresponding to the kinds of protective layers to use them suitably depending on recording conditions. Further, like this embodiment, there can be provided a plurality of control tables taking into consideration recording conditions other than the kind of protective layer, for example, the kind of recording medium.

The heat transfer sheet S in this embodiment will be described below. The heat transfer sheet S comprises the support $B_s$ and the layer $C_s$ to be transferred which is provided thereon, as described above. The support $B_s$ is preferably a heat-resistant support, and a polyethylene terephthalate (PET) film is preferably used.

The layer $C_s$ to be transferred is a layer which is transferred onto the recording medium to form the protective layer, and comprises a resin. The resin is preferably a resin which can form a coating excellent in adhesion to the recording medium, high in transparency, difficult to discolor by heat or light and excellent in chemical and physical barrier properties. Such resins include water-soluble resins such as polyvinyl alcohol (PVA), silanol-modified PVA, polyvinyl pyrrolidone (PVP), carboxymethyl cellulose (CMC), polyvinyl acetal, polyacrylamide, a cellulose derivative, casein, gelatin and urethane; resins such as an acrylic resin, a styrene-acrylic resin, polyethylene, vinyl acetate, ethylenebutadiene rubber (SBR) and acrylic acid ester; other thermoplastic resins; and hot melt adhesive resins. Of these, the styrene-acrylic resin is particularly preferably used in terms of transparency as the protective layer, cost and releasability from the base material. As these resins, ones commercially available as emulsions can be used.

The heat transfer sheet S is obtained by applying an emulsion of the above-mentioned resin onto the support $B_s$, and drying it to form the layer $C_s$ to be transferred.

In the invention, ordinary inks for ink jet recording can be all used. In particular, pigment ink is preferred because the long-term keeping qualities of the printed material are further improved. The ink for ink jet recording is generally an aqueous solution in which water is allowed to contain a coloring agent such as a dye or a pigment, and various solvent components and surfactants are each usually added thereto for adjustment of penetration, moisture retention and adjustment of viscosity.

The invention is not limited to the above-mentioned embodiments, and changes and modifications may be made without departing from the spirit and scope thereof.

For example, the overcoat process may be any, as long as it can provide the protective layer for covering the image on the recording medium, and is not limited to the above-mentioned heat transfer process. Other overcoat processes available in the invention include a process of applying onto the image an overcoat solution prepared by dissolving or dispersing a resin in an appropriate solvent (liquid lamination process); a process of discharging the overcoat solution using a recording head by an ink jet system; a process of laminating an adhesive film at ordinary temperature (cold lamination); and a process of laminating a film while heating it (thermosensitive bonding, heat lamination). As the films, there can be used films of polyethylene, polypropylene, polystyrene, polyethylene terephthalate, an acrylic resin, a polycarbonate, polyvinyl chloride and the like.

Further, it is preferred that the protective layer is formed so as to cover the whole face of the recording surface on which the image is formed, as shown in the above-mentioned embodiments. However, the protective layer may be formed so as to selectively cover only an image-formed area (the image and a neighborhood thereof). When the image-formed area is selectively covered with the protective layer, the above-mentioned protective layer formation process utilizing the ink jet system is suitable.

Furthermore, the ink jet recording apparatus of the invention may be any, as long as it comprises an ink jet recording device for discharging one or more kinds of inks based on entered image information to record an image of one or more colors on a recording medium, an overcoat device for forming a protective layer for covering the image on the recording medium, and control tables corresponding to changes in characteristics of the color(s) which occur by covering the color(s) output onto the recording medium with the protective layer, wherein the above-mentioned ink jet recording device performs discharge control of the ink(s) in accordance with the control tables to record the image, thereby making it possible to faithfully reproduce the entered image information. The specific constitution of each of these devices and other mechanisms are not limited to the above-mentioned embodiments, and can be properly modified. For example, in the above-mentioned embodiments, the roll-shaped recording medium is used. However, a cut sheet of a specific size such as the A4 size may be used.

According to the invention, the entered image information can be faithfully reproduced, and high image quality and high image fastness comparable to silver salt photographs can be attained.

That is, by the action of the protective layer covering the image, the printed material obtained according to the invention is good in luster to give a feeling of high quality, excellent in light resistance, gas resistance and abrasion resistance, high in fastness, difficult to bring about discoloration and fading with time over the long term, and storable for a long period of time. Further, the image is recorded making allowance for changes in image characteristics caused by the covering with the protective layer, so that the divergence from the entered image information is small, and the image is output as a user intends. Further, the print density is improved by formation of the protective layer, and the color reproduction range can be enlarged. Accordingly, the expression in a dark place becomes possible, the gradation of which was used to be impaired according to existing techniques.

Further, as described above, when the image is recorded by using the pigment ink, the effect of improving the image fastness is achieved more effectively. Furthermore, as described above, when the overcoat treatment is conducted by the heat transfer process of heat transferring onto the image the layer to be transferred which is provided on the support, the fine and smooth thin protective layer can be formed. Accordingly, the original texture and feeling of the recorded matter can be maintained.

While the invention has been described in detail and with reference to specific embodiments thereof, it will be apparent to one skilled in the art that various changes and modifications can be made therein without departing from the spirit and scope thereof.

This application is based on Japanese Patent Application No. 2001-352177 filed Nov. 16, 2001, the entire contents thereof being herein incorporated by reference.

What is claimed is:

1. An ink jet recording process comprising an ink jet recording step of discharging one or more kinds of inks based on entered image information to record an image of one or more colors on a recording medium, and an overcoat step of forming a protective layer for covering the image on the recording medium, wherein control tables corresponding to changes in characteristics of the color(s) which occur by covering the color(s) output onto the recording medium with the protective layer are prepared beforehand, and in the ink jet recording step, discharge control of the ink(s) is performed in accordance with the control tables to record the image, thereby making it possible to faithfully reproduce the entered image information.

2. The ink jet recording process according to claim 1, wherein making allowance for changes in the brightness index L* and the chromaticness indexes a* and b* defined in the CIE L*a*b* color space of a printed area, which occur by forming the protective layer on the image in the overcoat step, the control tables control at least the kind of ink used and/or the discharge amount so as to record an image in which these changes are deducted with respect to the entered image information.

3. The ink jet recording process according to claim 1, wherein a plurality of control tables are prepared corresponding to recording conditions at least including the kinds of protective layers, and the control table to be used is selected depending on the recording conditions.

4. The ink jet recording process according to claim 1, wherein the ink is pigment ink.

5. The ink jet recording process according to claim 1, wherein the overcoat step is conducted by heat transferring, onto the image, a layer to be transferred which is provided on a support.

6. An ink jet recording apparatus comprising an ink jet recording device for discharging one or more kinds of inks based on entered image information to record an image of one or more colors on a recording medium, and an overcoat device for forming a protective layer for covering the image on the recording medium, wherein the ink jet recording apparatus further comprises control tables corresponding to changes in characteristics of the color(s) which occur by covering the color(s) output onto the recording medium with the protective layer, and the ink jet recording device performs discharge control of the ink(s) in accordance with the control tables to record the image, thereby making it possible to faithfully reproduce the entered image information.

7. The ink jet recording apparatus according to claim 6, wherein making allowance for changes in the brightness index L* and the chromaticness indexes a* and b* defined in the CIE L*a*b* color space of a printed area, which occur by forming the protective layer on the image by the overcoat device, the control tables control at least the kind of ink used and/or the discharge amount so as to record an image in which these changes are deducted with respect to the entered image information.

8. The ink jet recording apparatus according to claim 6, wherein a plurality of control tables are provided corresponding to recording conditions including at least the kinds of protective layers, and the control table to be used is selected depending on the recording conditions.

9. The ink jet recording apparatus according to claim 6, wherein the overcoat device comprises a device for supplying, an a support, a heat transfer sheet having a layer to be transferred, a device for heat pressing, onto the image, a layer to be transferred, and a device for separating the support of the heat transfer sheet after the heat pressing.

10. The ink jet recording process according to claim 2, wherein a plurality of control tables are prepared corresponding to recording conditions at least including the kinds of protective layers, and the control table to be used is selected depending on the recording conditions.

11. The ink jet recording process according to claim 2, wherein the ink is pigment ink.

12. The inkjet recording process according to claim 3, wherein the ink is pigment ink.

13. The ink jet recording process according to claim 2, wherein the overcoat step is conducted by heat transferring, onto the image, a layer to be transferred which is provided on a support.

14. The ink jet recording process according to claim 3, wherein the overcoat step is conducted by heat transferring, onto the image, a layer to be transferred which is provided on a support.

15. The ink jet recording apparatus according to claim 7, wherein a plurality of control tables are provided corresponding to recording conditions including at least the kinds of protective layers, and the control table to be used is selected depending on the recording conditions.

16. The ink jet recording apparatus according to claim 7, wherein the overcoat device comprises a device for supplying, on a support, a heat transfer sheet having a layer to be transferred, a device for heat pressing, onto the image, a layer to be transferred, and a device for separating the support of the heat transfer sheet after the heat pressing.

17. The ink jet recording apparatus according to claim 8, wherein the overcoat device comprises a device for supplying, on a support, a heat transfer sheet having a layer to be transferred, a device for heat pressing, onto the image, a layer to be transferred, and a device for separating the support of the heat transfer sheet after the heat pressing.

* * * * *